US007019721B2

(12) United States Patent
Thielemans et al.

(10) Patent No.: US 7,019,721 B2
(45) Date of Patent: Mar. 28, 2006

(54) ORGANIC LIGHT-EMITTING DIODE DRIVE CIRCUIT FOR A DISPLAY APPLICATION

(75) Inventors: Robbie Thielemans, Nazareth (BE); Gino Tanghe, Merkem (BE); Herbert Van Hille, Cambridge, MA (US); Patrick Willem, Oostende (BE)

(73) Assignee: Naamloze Vennootschap, Barco, Kortrijk (BE)

( * ) Notice: Subject to any disclaimer, the term of this patent is extended or adjusted under 35 U.S.C. 154(b) by 24 days.

(21) Appl. No.: 10/434,343

(22) Filed: May 9, 2003

(65) Prior Publication Data

US 2005/0052141 A1 Mar. 10, 2005

(30) Foreign Application Priority Data

Apr. 24, 2003 (EP) ..... 03076232

(51) Int. Cl.
*G09G 3/32* (2006.01)

(52) U.S. Cl. ..... 345/82; 345/55; 345/91

(58) Field of Classification Search ..... 345/82, 345/55, 91, 83, 84, 204, 214, 48, 76, 77; 315/169.3, 169.4, 169.1, 164, 167
See application file for complete search history.

(56) References Cited

U.S. PATENT DOCUMENTS

| | | | | |
|---|---|---|---|---|
| 4,833,542 | A | 5/1989 | Hara et al. | |
| 5,796,376 | A | 8/1998 | Banks | |
| 6,014,119 | A | 1/2000 | Staring et al. | 345/82 |
| 6,097,351 | A | 8/2000 | Nishida | |
| 6,201,520 | B1 | 3/2001 | Iketsu et al. | 345/76 |
| 6,337,542 | B1 | 1/2002 | Hanaki et al. | |
| 6,366,026 | B1 | 4/2002 | Saito et al. | 315/169.3 |
| 6,486,607 | B1 | 11/2002 | Yeuan | |
| 6,498,592 | B1 | 12/2002 | Metthies | |
| 2002/0033783 | A1 | 3/2002 | Koyama | |
| 2002/0036605 | A1 | 3/2002 | Kawashima | 345/76 |
| 2002/0084536 | A1 | 7/2002 | Sundahl et al. | |
| 2002/0101171 | A1 | 8/2002 | Kao et al. | |
| 2003/0071804 | A1 | 4/2003 | Yamazaki et al. | |
| 2003/0184237 | A1 * | 10/2003 | Togashi et al. | 315/169.3 |

FOREIGN PATENT DOCUMENTS

| | | | |
|---|---|---|---|
| CN | 091118235 | * | 8/2002 |
| DE | 19950839 | A1 | 5/2001 |
| DE | 101 38 004 | A1 | 2/2003 |
| EP | 1033902 | A2 | 6/2000 |
| EP | 1 225 557 | A1 | 7/2002 |
| EP | 1227 466 | A2 | 7/2002 |
| EP | 1260958 | A2 | 11/2002 |
| EP | 1260 959 | A2 | 11/2002 |
| WO | WO9941788 | | 8/1999 |
| WO | 0065432 | A2 | 11/2000 |
| WO | 01 63587 | A2 | 8/2001 |
| WO | 02 47310 | A2 | 6/2002 |
| WO | 03 019510 | A2 | 3/2003 |

* cited by examiner

*Primary Examiner*—Tuyet Thi Vo
(74) *Attorney, Agent, or Firm*—Bacon & Thomas, PLLC

(57) ABSTRACT

An organic light-emitting diode drive circuit for a display application includes a plurality of organic light-emitting diodes (OLEDs) having an anode and a cathode, the organic light-emitting diodes being connected to anode lines and cathode lines, and at least one drive circuit. The organic light-emitting diodes are arranged in a common anode configuration, whereas the drive circuit is configured as a common anode drive device, so that each concerned cathode line can be connected by a respective first switch to a current source and so that each concerned anode line can be connected by a respective second switch to a positive power supply. The respective first switches are configured such that, when a cathode line is in use, a connection is made between the cathode line in use and the respective current source and, when the cathode line is unused, the cathode line is connected to a positive power supply.

9 Claims, 5 Drawing Sheets

ORGANIC LIGHT-EMITTING DIODE DRIVE CIRCUIT FOR A DISPLAY APPLICATION

FIELD OF THE INVENTION

The present invention relates to an organic light-emitting diode (OLED) drive circuit for a display application, more particularly for a common anode passive matrix display application.

BACKGROUND OF THE INVENTION

Organic light-emitting diode (OLED) technology incorporates organic luminescent materials that, when sandwiched between electrodes and subjected to a DC electric current, produce intense light of a variety of colors. These OLED structures can be combined into the picture elements or pixels that comprise a display. OLEDs are also useful in a variety of applications as discrete light-emitting devices, or as the active element of light-emitting arrays or displays, such as flat-panel displays in watches, telephones, laptop computers, pagers, cellular phones, calculators, and the like. To date, the use of light-emitting arrays or displays has been largely limited to small-screen applications such as those mentioned above.

Demands for large-screen display applications possessing higher quality and higher resolution has led the industry to turn to alternative display technologies that replace older LED and liquid crystal displays (LCDs). For example, LCDs fail to provide the bright, high light output, larger viewing angles and speed requirements that the large-screen display market demands. By contrast, OLED technology promises bright, vivid colors in high resolution and at wider viewing angles. However, the use of OLED technology in large-screen display applications, such as outdoor or indoor stadium displays, large marketing advertisement displays, and mass-public informational displays, is still in the development stage.

Several technical challenges exist relating to the use of OLED technology in a large-screen application. One such challenge is that OLED displays are expected to offer a wide dynamic range of colors, contrast and light intensity depending on various external environmental factors including ambient light, humidity and temperature. For example, outdoor displays are required to produce more white color contrast during the day and more black color contrast at night. Additionally, light output must be greater in bright sunlight and lower during darker, inclement weather conditions. The intensity of the light emission produced by an OLED device is directly proportional to the amount of current driving the device. Therefore, the more light output needed, the more current is fed to the pixel. Accordingly, less light emission is achieved by limiting the current to the OLED device.

A pixel, by definition, is a single point or unit of programmable color in a graphic image. However, a pixel may include an arrangement of sub-pixels, for example red, green and blue sub-pixels. It is known that such sub-pixels can be driven by a drive circuit having a common cathode configuration. According to a new technology, also a common anode configuration can be applied. These configurations refer to whether the three sub-pixels are addressed via a common cathode line or via a common anode line, respectively. Accordingly, in the common cathode configuration, the cathodes of the three sub-pixels are electrically connected and addressed in common. In the common anode configuration, the anodes of the three sub-pixels are electrically connected and addressed in common.

In the known common cathode drive circuit, a current source is arranged between each individual anode and a positive power supply, while the cathodes are electrically connected in common to ground. Consequently, the current and voltage are not independent of one another, thus small voltage variations result in fairly large current variations, having the further consequence of light output variations. Furthermore, in the common cathode configuration the constant current source is referenced to the positive power supply, so any small voltage variation results in a current variation. For these reasons, the common cathode configuration makes precise control of the light emission, which is dependent upon precise current control, more difficult.

By contrast, in an anode drive circuit, a current source is arranged between each individual cathode and ground, while the anodes are electrically connected in common to the positive power supply. As a result, the current and voltage are completely independent of one another; thus, small voltage variations do not result in current variations, thereby eliminating the further consequence of light output variations. Furthermore, in the common anode configuration the constant current source is referenced to ground, which does not vary, thereby eliminating any current variations due to its reference. For these reasons, the common anode configuration lends itself to precise control of the light emission needed in a large-screen display application.

Another consideration is that a common anode design requires NPN transistor design while common cathode design requires PNP transistor design. NPN transistors are smaller and faster than PNP transistors, which employ holes to carry the electric current as opposed to electrons. The electron carriers of the NPN transistors are smaller and much more mobile than their PNP counterparts. As a result, PNP transistors are 30–50% more costly than NPN transistors to manufacture because they require a larger quantity of materials for production.

An example of a pixel drive circuit is found in reference to U.S. Pat. No. 6,512,334, entitled, "Organic electroluminescence matrix-type single-pixel drivers." This patent describes an organic electroluminescence (OEL) matrix-type single-pixel driver that comprises an OEL device, a first transistor and a second transistor. The first transistor and the second transistor form a complementary structure so that when the data line uses the first transistor to drive an OLED device, the second transistor is in the OFF state, causing no power consumption. When the data line is in the LOW state, the first transistor is in the OFF state. The second transistor is in a sub-threshold state after getting rid of extra charges.

Although the control circuit described in U.S. Pat. No. 6,512,334 employs a switching mechanism to control anode voltages, it does not employ a common anode design, nor does it provide a means for incorporating smaller, faster and less expensive components. Furthermore, the drive circuit described in U.S. Pat. No. 6,512,334 provides only voltage control to each individual pixel in the matrix display and thus provides no means for the high currents necessary to produce high light output. Finally, the drive circuit of U.S. Pat. No. 6,512,334 does not provide a means for varying the amount of light output or controlling contrast in a high resolution passive matrix display.

SUMMARY OF THE INVENTION

It is an object of the present invention to provide an improved drive circuit that enables high light output combined with good contrast in a passive matrix OLED display using a common anode configuration.

It is another object of this invention to provide a drive circuit that enables a dynamic range in a passive matrix OLED display while improving speed and resolution using a common anode configuration.

It is yet another object of this invention to provide a drive circuit that precisely controls light output of each OLED in a passive matrix OLED display using a common anode configuration.

It is yet another object of this invention to provide a pixel drive circuit that uses faster, smaller and less expensive components than conventional OLED display drivers.

In order to realize such improved drive circuit, the present invention in first instance relates to an organic light-emitting diode drive circuit for a display application, said display comprising a plurality of organic light-emitting diodes (OLEDs) having an anode and a cathode, said organic light-emitting diodes (OLEDs) being connected to anode lines and cathode lines, and at least one drive circuit, said drive circuit being characterized in that the organic light-emitting diodes are arranged in a common anode configuration, whereas said drive circuit is configured as a common anode drive device, wherein each concerned cathode line by means of a respective first switch can be connected to a current source and wherein each concerned anode line by means of a respective second switch can be connected to a positive power supply; and in that the respective first switches are configured such that, when a cathode line is in use, a connection is made between the cathode line in use and the respective current source and, when said cathode line is unused, this cathode line is connected to a positive power supply.

By connecting the cathodes of unused or inactive OLEDs to the positive power supply, a number of problems, which are the result of reverse current through certain inactive OLEDs, can be eliminated, as will be explained hereafter in the detailed description.

In a preferred embodiment, the positive power supply to which the first switches can be connected and the positive power supply to which the second switches can be connected are the same, resulting in that a further improved effect is obtained.

In the most preferred embodiment, the drive circuit is further characterized in that said second switches are configured such that, when an anode line is in use, a connection is made between the anode line in use and a respective positive power supply and, when said anode line is unused, this anode line is connected to ground.

In this way, further disadvantages of reverse currents through certain OLEDs, said reverse currents inducing limited currents in forward direction through other OLEDs, resulting in that the latter become lit up to a certain extent, can be avoided, as will be explained in detail in the detailed description.

Preferably, the current sources are referenced to ground.

According to a particular form of embodiment, the drive circuit according to the invention is further characterized in that said anode lines and cathode lines are arranged along a substrate whereby multiple pixels are formed, said anode lines and cathode lines being formed of a conductive layer; and in that at least one of said cathode lines or anode lines of the display shows a plurality of electrical connections spread over the length of said at least one line, which connections provide in an electrical connection to a common electrical conducting element of more massive structure than the conductive layers formed on the substrate, so as to reduce the parasitic series resistance of the material used for the conductive layers and/or so as to reduce the parasitic capacitance of the OLED display itself.

BRIEF DESCRIPTION OF THE DRAWINGS

With the intention of better showing the characteristics of the invention, hereafter as examples without any limitative character, several preferred forms of embodiment are described, with reference to accompanying drawings, wherein:

FIG. 2 shows a schematic diagram of an OLED drive circuit in accordance with an embodiment of the invention;

DETAILED DESCRIPTION OF PREFERRED EMBODIMENTS

The present invention is a drive circuit for a passive matrix organic light-emitting diode (OLED) display arranged in a common anode configuration. The present invention further enables precision control of light output for each individual OLED device in order to provide high light output and dynamic color intensity ranges simultaneously.

Figure 1:
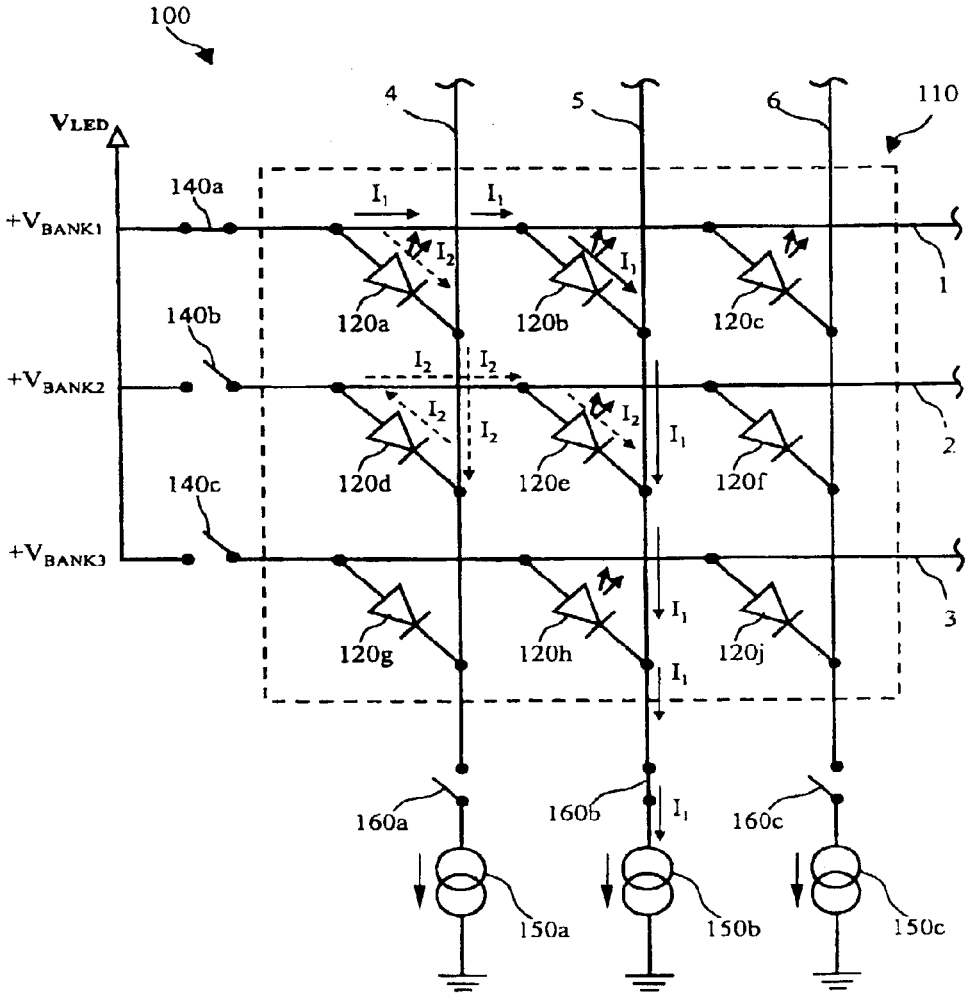
FIG. 1 shows a schematic diagram of a common anode OLED drive circuit.
Figure 9:
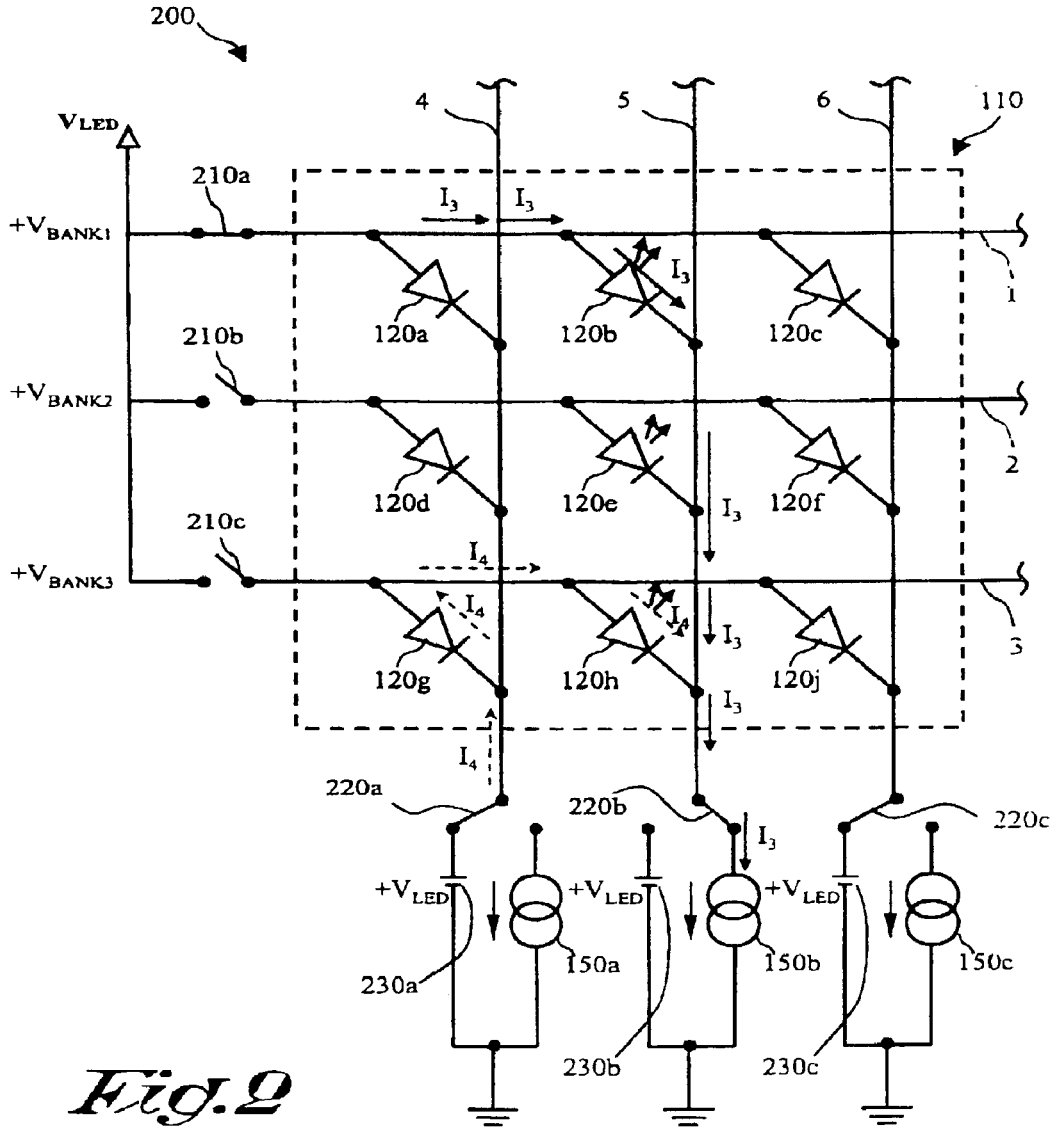

FIG. 1 illustrates a schematic diagram for an OLED drive circuit 100 that includes an OLED array 110, which is representative of a portion of a common anode OLED display. OLED array 110 further includes a plurality of OLEDs 120 (each having an anode and cathode as is well known) arranged in a matrix of rows and columns. For example, OLED array 110 is formed of OLEDs 120*a* through 120*j* arranged in a 3×3 array, where the anodes of OLEDs 120*a*, 120*b*, and 120*c* are electrically connected to row line 1, the anodes of OLEDs 120*d*, 120*e*, and 120*f* are electrically connected to row line 2, and the anodes of OLEDs 120*g*, 120*h*, and 120*j* are electrically connected to row line 3. OLED array 110 may be any dimension, but is shown here as a 3×3 array for illustrative purposes only. Furthermore, the cathodes of OLEDs 120*a*, 120*d* and 120*g* are electrically connected to a column line 4, the cathodes of OLEDs 120*b*, 120*e* and 120*h* are electrically connected to a column line 5, and the cathodes of OLEDs 120*c*, 120*f*, and 120*j* are electrically connected to a column line 6.

A positive voltage $+V_{LED}$, typically ranging between 3 and 20 volts, is electrically connected to each respective row line via a plurality of switches 140. Switches 140 are conventional active switch devices, such as FET switches or transistors having suitable voltage and current ratings. More specifically, $+V_{LED}$ is electrically connected to row line 1 via switch 140*a*, $+V_{LED}$ is electrically connected to row line 2 via switch 140*b*, and $+V_{LED}$ is electrically connected to row line 3 via switch 140*c*. OLED drive circuit 100 further includes a plurality of current sources 150, for example, a current source 150*a* that may be coupled to column line 4 via a switch 160*a*, a current source 150*b* that may be coupled to column line 5 via a switch 160*b*, and a current source 150*c* that may be coupled to column line 6 via a switch 160*c*. Current sources 150 are conventional current sources capable of supplying a constant current typically in the range of 5 to 50 mA. Examples of constant current devices include a Toshiba TB62705 (8-bit constant current LED driver with shift register and latch functions) and a Silicon Touch ST2226A (a PWM-controlled constant current driver for LED displays).

OLED array 110 within the OLED drive circuit 100 is arranged in the common anode configuration. In this way, the current and voltage are independent of one another, providing better control of the light emission.

Each OLED 120 represents a sub-pixel (typically red, green, or blue; however, any color variants are acceptable) and emits light when the voltage difference between the anode and cathode for an OLED 120 is at least 1,5 V (typically the range is 1,5–3 V) in conjunction with adequate current amperages. In operation, $+V_{LED}$ is applied to the anode of a given OLED 120 by closing its corresponding switch 140 within its corresponding row line. If one wants to light up an OLED 120, its corresponding current source 150 is applied by closing its associated switch 160 within its corresponding column line. In this manner, current flows through the selected OLED 120, which acts as a capacitor, until the threshold voltage of 1,5–3V is present across its electrodes. Once the desired threshold voltage is achieved, the selected OLED 120 emits light at intensities proportional to the amount of current flowing through it. The standard measure of light output or luminance for an OLED display is in candela per square meter (cd/m$^2$) and is commonly referred to as a nit: 1 cd/m$^2$=1 nit. For large displays, a range of 300–2000 nit is desirable. The current density and, thus, luminance is controlled by controlling current source 150. To illustrate, the following example shows the process for gaining light emission from OLED 120*b* of OLED array 110.

In this example, switch 140*a* is closed and therefore electrically connects $+V_{LED}$ to row line 1. To cause light emission from OLED 120*b*, switch 160*b* is closed and therefore electrically connects current source 150*b* to column line 5. In this way, OLED 120*b* is forward biased and current $I_1$ flows through OLED 120*b*. Once the typical device threshold voltage of 1,5–3V is achieved across its electrodes (from cathode to anode), OLED 120*b* emits light. Opening switch 160*b* deactivates OLED 120*b*.

Switches 140 are always opened/closed in sequence according to a duty cycle. Switches 160 determine whether an OLED 120 emits light. The on-time of a switch 160 is between 0 (no light output) and one on-period of a switch 140. The longer switch 160 is closed, the more light output will be generated from a corresponding OLED 120.

However in said OLED drive circuit 100, activating OLED 120*b* also induces current $I_2$ in neighbouring row line 1 and column line 5, thereby causing undesired light emission from OLEDs 120 along row line 1 as well as from OLEDs 120 along column line 5. This is due to an undesired inverse current flowing through OLEDs 120 in the same row and OLEDs 120 in the same column. Reverse bias current, while exhibited in small amounts in conventional semiconductor light-emitting diodes (e.g. 10–100 μA), may be as high as 0,1 mA/cm$^2$, for an OLED 120, depending on the manufacture of the diode. This is enough current to light a forward biased diode in the short circuit path to the ground.

For example, since $+V_{LED}$ is connected to row line 1 and current source 150*b* is connected to column line 5 in order to activate OLED 120*b*, a current 12 flows from $+V_{LED}$ to current source 150*b* via an alternate path as follows. Current $I_2$ flows along row line 1 to the anode of OLED 120*a*. Subsequently, current $I_2$ flows from the anode to the cathode of OLED 120*a* in the forward direction. Subsequently, current $I_2$ flows along column line 4 and reaches the cathode of OLED 120*d*. Subsequently, current $I_2$ flows from the cathode to the anode of OLED 120*d* in the reverse direction. Subsequently, current $I_2$ flows along row line 2 and reaches the anode of OLED 120*e*. Subsequently, current $I_2$ flows from the anode to the cathode of OLED 120*e* in the forward direction. Since the cathode of OLED 120*e* is connected to column line 5, the alternate path to current source 150*b* is completed. Since current $I_2$ is flowing through OLED 120*d* in the reverse direction, OLED 120*d* does not emit any light. However, because current $I_2$ is flowing through OLED 120*a* and OLED 120*e* in the forward direction, OLED 120*a* and OLED 120*e* emit a small amount of light. Although still not acceptable, the light emission of OLED 120*a* and OLED 120*e* is small compared with the light emission of OLED 120*b* because current 12 is small compared with current $I_1$ and because the threshold voltage of 1,5–3V is barely achieved across OLED 120*a* and OLED 120*e*. Similarly, in this manner, the entire row and column of OLEDs 120 for row line 1 and column line 5 emits varying nits of light. Inverse current $I_2$, in this example, makes it impossible to control a single sub-pixel (OLED 120*b*) individually without undue light emission from neighbouring OLED devices within its row and column address.

FIG. 2 illustrates a schematic diagram of an OLED drive circuit 200 in accordance with an embodiment of the invention. OLED drive circuit 200 includes OLED array 110 as described in FIG. 1, which is a common anode design, along with additional driver circuitry. OLED drive circuit 200 further includes a switch 210*a* that couples row line 1 to either $+V_{LED}$ or high Z (i.e. open circuit) as shown. In a similar manner, a switch 210*b* couples row line 2 to either $+V_{LED}$ or high Z and a switch 210*c* couples row line 3 to either $+V_{LED}$ or high Z. Furthermore, a switch 220*a* couples column line 4 to either a voltage source 230*a* that provides a positive $+V_{LED}$ voltage of typically 3–20 V or to current source 150*a* as depicted in the scheme. In a similar manner, a switch 220*b* couples column line 5 to either a voltage source 230*b* or current source 150*b*, and a switch 220*c* couples column line 6 to either a voltage source 230*c* or current source 150*c*.

As in the previous example, shown in FIG. 1, in order to emit light from OLED 120*b* it is necessary to have row line 1 connected to $+V_{LED}$ via switch 210*a* and column line 5 connected to current source 150*b* via switch 220*b* at the same time. Current $I_3$ flows from $+V_{LED}$ through OLED 120*b* and through column line 5 to current source 150*b*. This process allows OLED 120*b* to become forward biased and, once the typical device threshold voltage of 1,5–3V is achieved across OLED 120*b*, OLED 120*b* emits light.

In order to prevent OLED 120*a* and OLED 120*c* from emitting light, column line 4 and column line 6 are connected to positive voltage sources 230*a* and 230*c* respectively. Since the anodes of both OLED 120*a* and 120*c* are connected to $+V_{LED}$ and the cathodes are connected to $+V_{LED}$, there is no voltage potential across OLED 120*a* or 120*c* and thus, neither emits light. Therefore, connecting the cathodes of unused OLEDs 120 to $+V_{LED}$ eliminates the problem of reverse current described in FIG. 1 where an entire row of OLEDs 120 produced light.

However, inverse currents are produced in OLED array 110 that cause OLEDs 120*e* and 120*h* to emit light. Inverse current 14 flows inversely through OLED 120*g* because its cathode is connected to $+V_{LED}$ while the anode is at a high Z. In this manner, inverse current $I_4$ is driven from column line 4 inversely through OLED 120*g* to the anode of OLED 120*h*, causing OLED 120*h* to emit light. In a similar manner, inverse current flows through OLED 120*d* and proceeds through forward biased OLED 120*e* causing OLED 120*e* to emit light.

Therefore, OLED drive circuit 200, while eliminating the effects of reverse current along the row line of a specific OLED 120, does not completely eliminate reverse current effects along the corresponding column line of OLEDs 120. However, for some applications it may not be necessary to eliminate all reverse current effects within OLED array 110.

Figure 3:
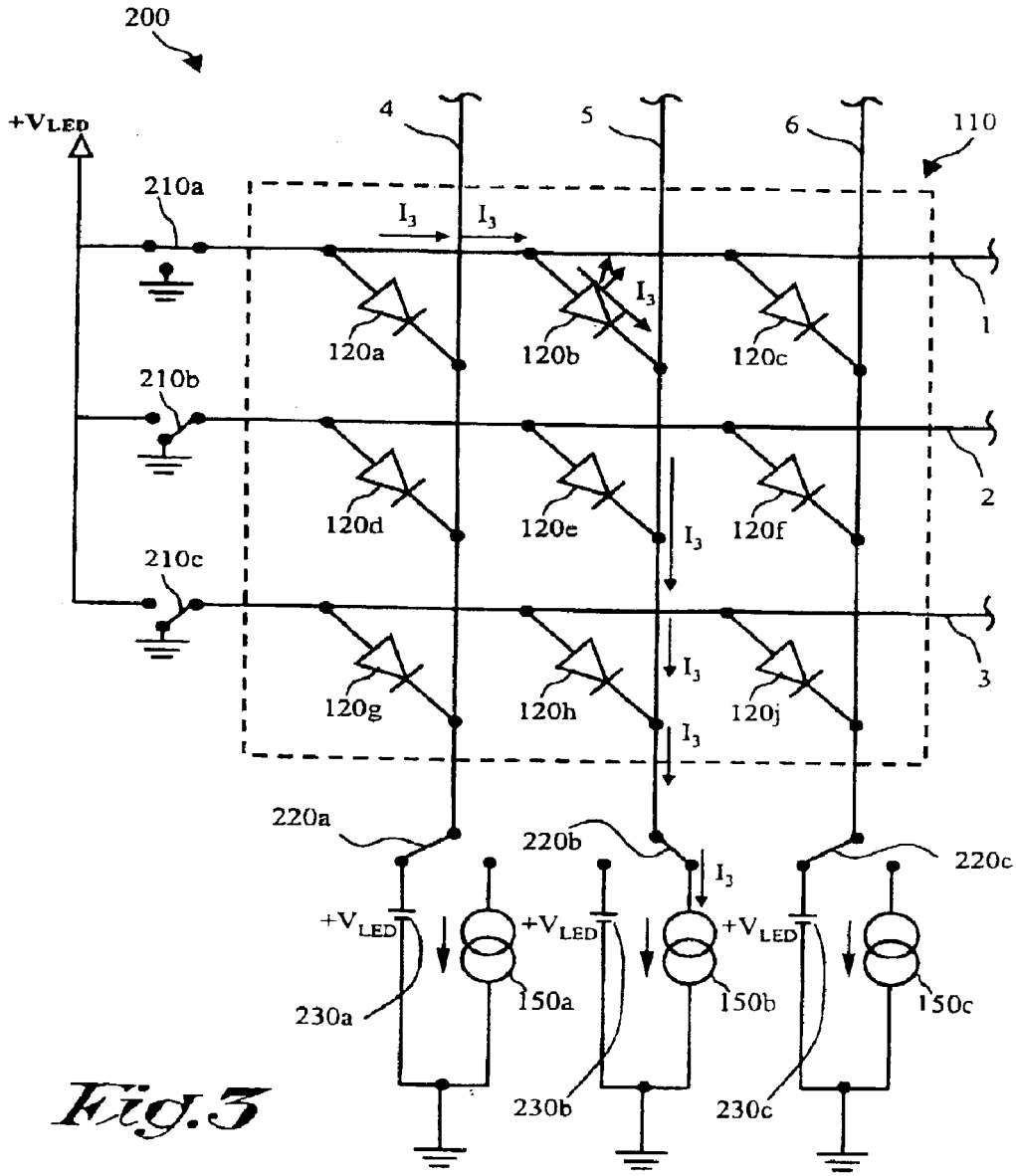
FIG. 3 shows a schematic diagram of an OLED drive circuit in accordance with a preferred embodiment of the invention.

FIG. 3 illustrates a schematic diagram of an OLED drive circuit 200 in accordance with a preferred embodiment of the invention. OLED drive circuit 200 further includes switch 210*a* that couples row line 1 to either $+V_{LED}$ or ground (in contrast to FIG. 2 where switch 210*a* coupled row line 1 to either $+V_{LED}$ or high Z). In a similar manner, switch 210*b* couples row line 2 to either $+V_{LED}$ or ground and switch 210*c* couples row line 3 to either $+V_{LED}$ or ground. This switching of row lines 1, 2 and 3 between $+V_{LED}$ and ground and column lines 4, 5, and 6 between current sources 150 or $+V_{LED}$ ensures that there are no open circuits during the operation.

In accordance with the preferred embodiment, row line 2 and row line 3 are connected to ground via switches 210*b* and 210*c* respectively in order to prevent OLED 120*e* and 120*h* from emitting light. Without the electrical connection of unused row lines to ground, a reverse current is induced in OLEDs 120*d*, 120*f*, 120*g*, and 120*j* that causes OLEDs 120*e* and 120*h* to emit unwanted light (as described in FIG. 2). However, ensuring that unused row lines are electrically connected to ground ensures that an entire column of OLEDs 120 does not emit unwanted light.

Therefore, to emit light only from OLED 120*b* (as described in the previous examples) the anodes of OLED 120*a*, 120*b*, and 120*c* are each connected to $+V_{LED}$ via switch 210*a* and the cathode of OLED 120*b* directly connects to current source 150*b* via switch 220*b*. The cathodes of OLED 120*a* and OLED 120*c* are both directly coupled to positive voltage sources 230*a* and 230*c*, respectively. Thus, no current flows through either OLED 120*a* or OLED 120*c* due to the absence of voltage potentials across the devices and therefore, neither OLED 120*a* nor OLED 120*c* produces any light. Furthermore, no current flows through OLED 120*e* or OLED 120*h* since all inverse currents produced in OLED array 110 flow to ground via switch 210*b* and switch 210*c*. Therefore, the only light source produce in OLED array 110 is from OLED 120*b*. In this manner, any individual OLED 120 or bank of OLEDs 120 maybe induced to emit light by controlling switches 210*a* through 210*c* and switches 220*a* through 220*c*.

The following table (Table 1) is a truth table of switch states required for activating each of the nine OLEDs 120 of OLED drive circuit 200.

TABLE 1

| | Switch 210a | Switch 210b | Switch 210c | Switch 220a | Switch 220b | Switch 220c |
|---|---|---|---|---|---|---|
| OLED 120a | $+V_{LED}$ | GND | GND | Current source 150a | Voltage source 230b | Voltage source 230c |
| OLED 120b | $+V_{LED}$ | GND | GND | Voltage source 230a | Current source 150b | Voltage source 230c |
| OLED 120c | $+V_{LED}$ | GND | GND | Voltage source 230a | Voltage source 230b | Current source 150c |

TABLE 1-continued

| | Switch 210a | Switch 210b | Switch 210c | Switch 220a | Switch 220b | Switch 220c |
|---|---|---|---|---|---|---|
| OLED 120d | GND | $+V_{LED}$ | GND | Current source 150a | Voltage source 230b | Voltage source 230c |
| OLED 120e | GND | $+V_{LED}$ | GND | Voltage source 230a | Current source 150b | Voltage source 230c |
| OLED 120f | GND | $+V_{LED}$ | GND | Voltage source 230a | Voltage source 230b | Current source 150c |
| OLED 120g | GND | GND | $+V_{LED}$ | Current source 150a | Voltage source 230b | Voltage source 230c |
| OLED 120h | GND | GND | $+V_{LED}$ | Voltage source 230a | Current source 150b | Voltage source 230c |
| OLED 120j | GND | GND | $+V_{LED}$ | Voltage source 230a | Voltage source 230b | Current source 150c |

In summary, any inactive row line is tied to ground at the same time that the active row line is tied to $+V_{LED}$. Furthermore, any inactive column line is tied to a positive voltage at the same time that the active column line is tied to its current source. In this way, alternate current paths due to the inverse current of any OLED 120 are avoided.

Furthermore, OLED drive circuit 200 uses a common anode design whereby each OLED 120 represents one of three sub-pixels within a pixel. For example, a red sub-pixel (e.g., OLED 120*a*), a green sub-pixel (e.g., OLED 120*b*), and a blue sub-pixel (e.g., OLED 120*c*) of a pixel share a common anode (row line 1 in this example).

Figure 4:
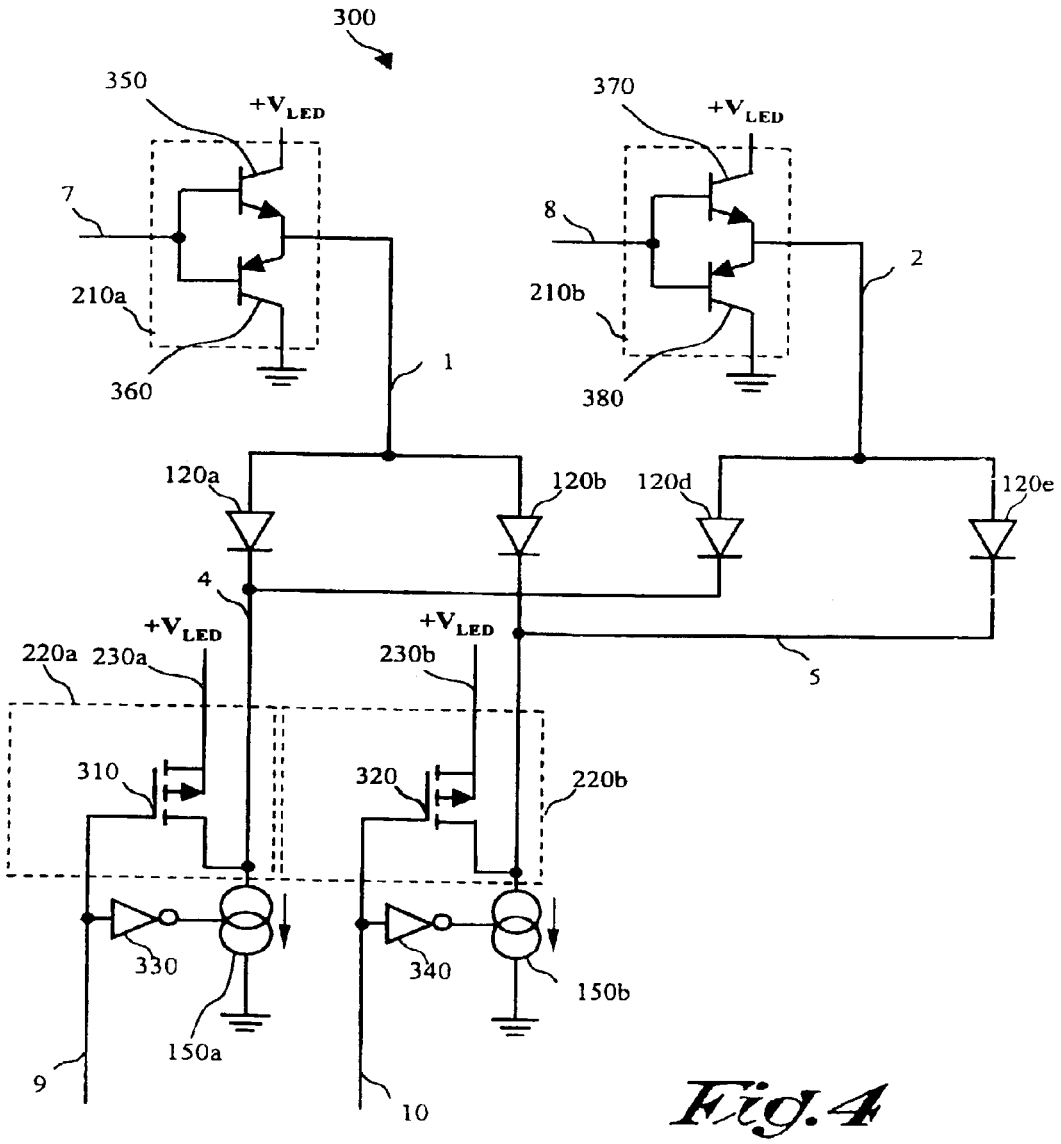
FIG. 4 shows a more detailed schematic diagram of a small portion of the OLED drive circuit of the invention.

FIG. 4 illustrates a schematic diagram of an OLED drive circuit 300 showing more details of a small portion of OLED drive circuit 200. OLED drive circuit 300 includes $+V_{LED}$, row line 1, row line 2, switch 210*a* that further includes a transistor 350 and a transistor 360, switch 210*b* that further includes a transistor 370 and a transistor 380, a switch control line 7, a switch control line 8, OLED 120*a*, OLED 120*b*, OLED 120*d*, and OLED 120*e*. OLED drive circuit 300 further includes voltage source 230*a*, switch 220*a* that further includes a MOSFET 310, voltage source 230*b*, switch 220*b* that further includes a MOSFET 320, current source 150*a*, current source 150*b*, a control line 9, a control line 10, an inverter 330, and an inverter 340. As described in FIG. 2, switch 210*a* and switch 210*b* may not connect to ground but rather provide a high Z value instead. However, in the preferred embodiment switches 210*a* and 210*b* are coupled to ground as shown.

MOSFET 310 is a P-channel FET arranged in parallel with current source 150*a*. More specifically, the drain of MOSFET 310 is electrically connected to the cathodes of OLEDs 120*a* and 120*d*, the source of MOSFET 310 is electrically connected to voltage source $+V_{LED}$ 230*a*, and the gate of MOSFET 310 is electrically connected to control line 9. Similarly, the drain of MOSFET 320 is electrically connected to the cathodes of OLEDs 120*b* and 120*e*, the source of MOSFET 320 is electrically connected to voltage source $+V_{LED}$ 230*b*, and the gate of MOSFET 320 is electrically connected to control line 10.

OLED drive circuit 300 is an example of one detailed implementation of OLED drive circuit 200 of FIG. 2. Other components may be used to achieve the same results without deviating from the scope and spirit of the present invention. For example, switch 210*a* includes transistor 350, which may be an NPN transistor, and transistor 360, which may be a PNP transistor; however, other CMOS or bipolar devices may be used with the same results. MOSFET 310 and MOSFET 320 are any conventional PMOS transistor devices having suitable voltage and current ratings for this application. However, MOSFET 310 and MOSFET 320 are representative of any suitable active switch device.

In operation, pulse width modulated (PWM) control signals are used to control the switching functions in the column lines within OLED drive circuit 300. Time multiplexing is used to control switches 210 on the switch control lines. The amount of time a pulse on control line 9 or 10 is "on" determines how much current flows through a given path. The longer a control line signal is "on", the more current is produced and, thus, the brighter a given OLED 120 becomes. The signal of control line 9 controls switch 220*a* and current source 150*a*. The signal of control line 10 controls switch 220*b* and current source 150*b*. Similarly, the signal of switch control line 7 controls switch 210*a* and the signal of switch control line 8 controls switch 210*b*.

Inverter 330 inverts the signal on control line 9 that feeds current source 150*a* so that switch 220*a* and current source 150*a* may never be "on" simultaneously (with the exception, however, of the propagation delay of inverter 330). When a signal on control line 9 causes MOSFET 310 to be active, MOSFET 310 transfers the positive voltage of voltage source 230*a* to column line 4, while inverter 330 creates an inverted signal at its output, thereby ensuring that current source 150*a* is not active. Furthermore, a signal on control line 9 that causes MOSFET 310 to be inactive also produces an inverted signal at the input to current source 150*a*, thus enabling current to flow on column line 4. However, in order to produce light emission, a corresponding anode for an OLED 120 must be connected to an ideal operating voltage. For example, switch 210*a* must also electrically connect row line 1 to $+V_{LED}$ in order to induce light emission from OLED 120*a*, or switch 210*b* must electrically connect row line 2 to $+V_{LED}$ in order to produce light from OLED 120*d*.

In a similar manner, PWM signals on control line 10 determine the current driving ability on column line 5, and thus control the cathode side of OLEDs 120*b* and 120*e*. Switch 210*a* controls the anode of OLED 120*b* and switch 210*b* controls the anode of OLED 120*e*. Therefore, light emits from OLED 120*b* when the signal on control line 10 causes MOSFET 320 to be inactive. Thus, the input to current source 150*b* through inverter 340 is "on" and current flows through column line 5. At the same time, a signal on switch control line 7 causes switch 210*a* to electrically connect row line 1 to an ideal operating voltage provided by $+V_{LED}$.

The following table (Table 2) is a truth table of switch states required for activating each of the four OLEDs 120 of OLED drive circuit 300.

TABLE 2

| | Switch 210a | Switch 210b | Switch 220a | Switch 220b |
|---|---|---|---|---|
| OLED 120a | $+V_{LED}$ | GND | Current source 150a | Voltage source 230b |
| OLED 120b | $+V_{LED}$ | GND | Voltage source 230a | Current source 150b |
| OLED 120d | GND | $+V_{LED}$ | Current source 150a | Voltage source 230b |
| OLED 120e | GND | $+V_{LED}$ | Voltage source 230a | Current source 150b |

The switch control lines are controlled by a time division multiplexed signal. The time division is dependent upon the number of row lines or groups of row lines. For example, several row lines may be controlled simultaneously as a group or bank by a single switch control line. Each switch control line carries a bank signal that defines whether switches 210 are connected to $+V_{LED}$ or ground for a given period of time. If there are N banks, then the corresponding duty cycle is 1/(k.N) where k is a predefined multiple. Switches 210 are connected to $+V_{LED}$ for a time of 1/N.T, and connected to the ground for a time (N−1)/N.T, where T is defined as a time period typically equal to 1 msec. Therefore, switch control lines carry timed bank signals and thus operate independently of the light output required from OLEDs 120. As a result, the anodes of OLEDs 120 are intermittently connected to $+V_{LED}$ and then ground based on the time multiplexed bank signals on the switch control lines regardless of whether the corresponding OLEDs 120 are required to produce light. In contrast the PWM signal on the control lines controls when each OLED 120 produces light. Each PWM signal connects a column line to current source 150 for a corresponding OLED 120 whose anode is connected to $+V_{LED}$ in order to produce light. The PWM signal triggers switch 220 to connect the column line to $+V_{LED}$ as soon as corresponding OLED 120 is not required to produce light, regardless if the anode of the particular OLED 120 is still connected to $+V_{LED}$.

Figure 5:
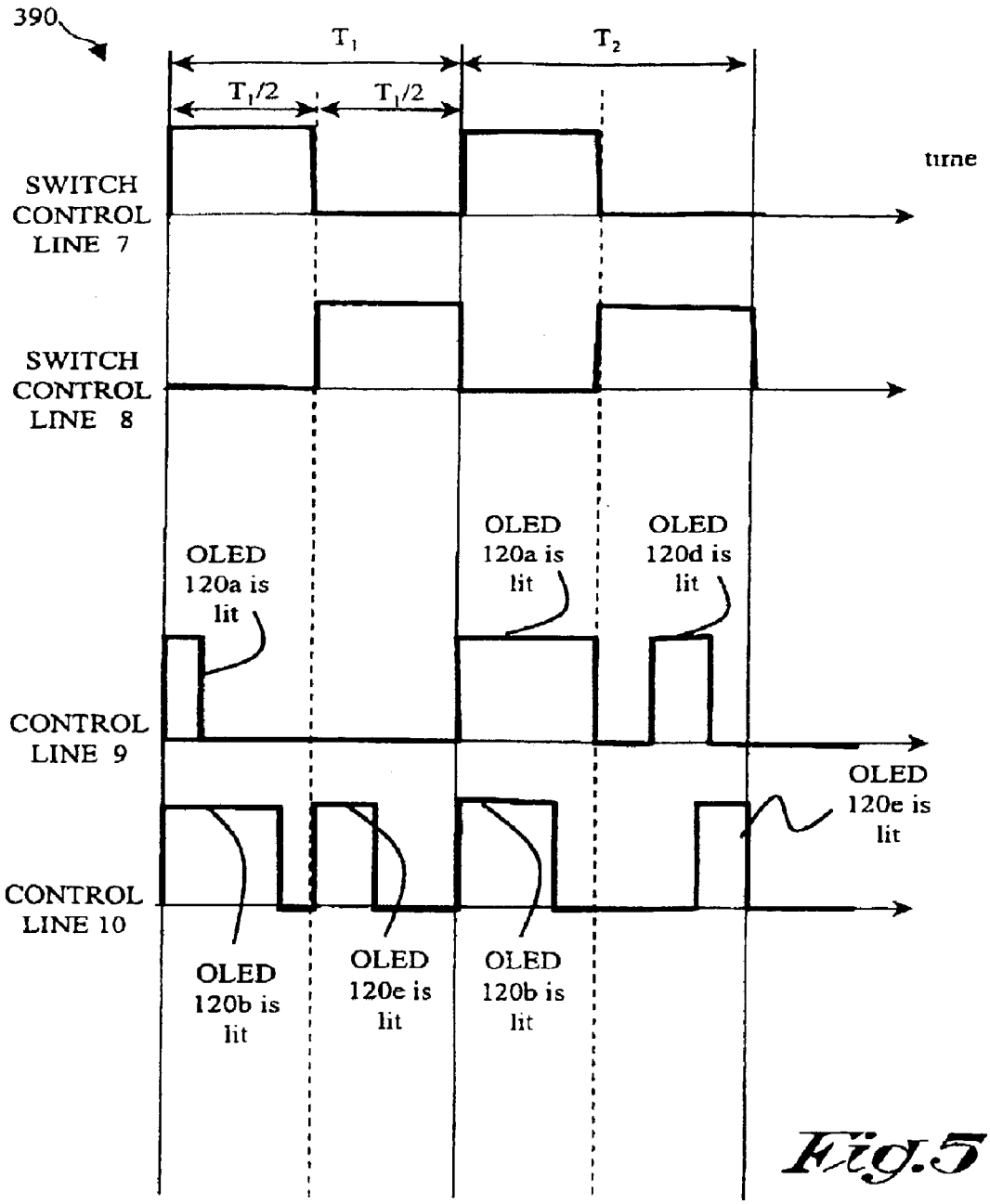
FIG. 5 shows an example timing diagram for the control signals of an OLED drive circuit.

FIG. 5 shows a timing diagram 390 of an example signal state where the number of banks is two and a duty cycle of ½ is engaged. When switch control line 7 is high, $+V_{LED}$ is connected to the corresponding row line 1. When a switch control line 7 is low, the corresponding row line 1 is connected to ground. Similarly when switch control line 8 is high, $+V_{LED}$ is connected to the corresponding row line 2. When a switch control line 8 is low, the corresponding row line 2 is connected to ground. When a control line 9 is high, current source 150*a* is connected to the corresponding column line 4. When the signal of control line 9 is low, $+V_{LED}$ voltage source 230*a* is connected to the corresponding column line 4. Similarly, when the signal of control line 10 is high, current source 150*b* is connected to the corresponding column line 5. When the signal of control line 10 is low, $+V_{LED}$ voltage source 230*b* is connected to the corresponding column line 5. As shown in FIG. 5, OLED 120*a* and OLED 120*b*, are lit up during the first half of time period $T_1$, while OLED 120*e* is lit during the second half of time period $T_1$. Similarly, OLED 120*a* and OLED 120*b* are lit for a portion of the first half of the second time period $T_2$ while OLEDs 120*e* and 120*d* are lit during a portion of the second half of that time frame $T_2$. In this manner, the PWM signals on the control lines and the bank signals on the switch control lines dictate when an OLED 120 produces light.

OLED drive circuit 300 further provides the added benefit of discharging an OLED 120. OLED 120 is immediately discharged once the corresponding current source is turned off if the anode of OLED 120 is electrically connected to a positive voltage and the corresponding cathode is also connected to a positive voltage for a period of time, which preferably is ranging from 100 ns–1000 ns. This application of equivalent voltages to both the anode and cathode of OLED 120 rapidly discharges OLED 120 without emitting light. This eliminates excessive light emission by a particular OLED 120 after its corresponding current source has been deactivated.

Furthermore, OLED drive circuit 300 provides a means for precisely controlling each OLED 120 in a given display matrix using time multiplexing signals, i.e., control line 9 and/or control line 10 in conjunction with PWM signals, i.e.

switch control 7 and/or switch control 8. Furthermore, the common anode design offers the ability to use smaller NPN transistor components, which are faster and less expensive than the PNP transistors required by common cathode configurations. The use of smaller and faster components provides a greater system speed, which ultimately provides faster display update and refresh times. Common anode design also decouples power supply fluctuations from the current drivers and prevents current fluctuations that degrade display quality by adversely affecting light output. Finally, the ability to produce varying anode voltages for the various ideal operating ranges of each colored sub-pixel provides the system with high dynamic ranges at high resolution.

It is clear that the afore-mentioned column lines 4–5–6 are identical to the "cathode lines" mentioned in the summary of the invention and in the appended claims. Similarly, the row lines 1–2–3 correspond to the "anode lines" mentioned in the summary of the invention and in the appended claims.

The afore-mentioned switches which cooperate with the column lines are identical to the "first switches" mentioned in the summary of the invention and in the claims, whereas the switches which cooperate with the row lines are identical to the "second switches".

Furthermore, it is clear that with the "positive power supply" mentioned in the summary of the invention and in the claims, a positive voltage is meant, such as the in the figures indicated voltage $+V_{LED}$.

The present invention is in no way limited to the forms of embodiment described by way of example and represented in figures, however such drive circuit can be realized in various forms without leaving the scope of the invention.

What is claimed is:

1. Organic light-emitting diode drive circuit for a display application, said display comprising a plurality of organic light-emitting diodes (OLEDs) (120) having an anode and a cathode, said organic light-emitting diodes (OLEDs) (120) being connected to anode lines (1–2–3) and cathode lines (4–5–6), and at least one drive circuit (200–300), characterized in that the organic light-emitting diodes are arranged in a common anode configuration, whereas said drive circuit (200–300) is configured as a common anode drive device, wherein each said cathode line by means of a respective first switch (220*a*–220*b*–220*c*) is arranged to be connected to a current source (150*a*–150*b*–150*c*) and wherein each said anode line by means of a respective second switch (210*a*–210*b*–210*c*) is arranged to be connected to a positive power supply; and in that the respective first switches (220*a*–220*b*–220*c*) are configured such that, when a cathode line is in use, a direct connection is made between the cathodes of the organic light emitting diodes (OLEDs) (120) in use and the respective current source (150*a*–150*b*–150*c*) and, when said cathode line is unused, each of the cathodes of the unused organic light emitting diodes (OLEDs) (120) is directly connected to a positive power supply.

2. Organic light-emitting diode drive circuit according to claim 1, wherein multiple pixels are formed, said anode lines (1–2–3) and cathode lines (4–5–6) being formed of a conductive layer; and wherein at least one of said cathode lines (4–5–6) or anode lines (1–2–3) of the display includes a plurality of electrical connections spread over the length of said at least one line, which connections provide an electrical connection to a common electrical conducting element of more massive structure than the conductive layers that form the anode lines and cathode lines, so as to reduce the parasitic series resistance of the material used for the conductive layers and/or so as to reduce the parasitic capacitance of the OLED display itself.

3. Organic light-emitting diode drive circuit according to claim 1, wherein said current sources (150*a*–150*b*–150*c*) are permanently referenced to ground.

4. Organic light-emitting diode drive circuit according to claim 1, wherein said respective first switch (220*a*–220*b*–220*c*) consists of an active switch device.

5. Organic light-emitting diode drive circuit according to claim 1, wherein several anode lines (1–2–3) are controlled simultaneously as a group or bank, by a single switch control line.

6. Organic light-emitting diode drive circuit according to claim 1, wherein said respective first switch (220*a*–220*b*) comprises a MOSFET (310–320) of which the gate is electrically connected to respective control lines (9–10); the drain of the MOSFET (310–320) being electrically connected to the cathodes of said OLEDs (120) and the source being electrically connected to a voltage source (230*a*–230*b*).

7. Organic light-emitting diode drive circuit according to claim 6, wherein said control lines (9–10) are connected to a pulse width modulator, which provides control signals to control the switching functions of the respective cathode line (4–5).

8. Organic light-emitting diode drive circuit according to claim 1, wherein said respective second switch (210*a*–210*b*) comprises a first transistor (350–370) and a second transistor (360–380); wherein said respective second switch (210*a*–210*b*) is connected to a respective switch control line (7–8), and to a respective anode line (1–2), which is connected to the respective common anodes of the organic light-emitting diodes (OLEDs) (120); and wherein said switch control lines (7–8) are controlled by a time division multiplexed signal.

9. Organic light-emitting diode drive circuit according to claim 8, wherein said second switches (210*a*–210*b*–210*c*) are configured such that, when an anode line is in use, a connection is made between the anode line in use and a respective power supply and, when said anode line is unused, this anode line is connected to the ground; and wherein any unused or inactive anode line is tied to the ground at the same time that an inactive anode line is tied to a positive power supply.

* * * * *